US011790818B2

(12) United States Patent
Su et al.

(10) Patent No.: US 11,790,818 B2
(45) Date of Patent: Oct. 17, 2023

(54) METHOD, APPARATUS AND SYSTEM FOR DEBUGGING DISPLAY PANEL

(71) Applicants: BOE Technology Group Co., Ltd., Beijing (CN); Beijing BOE Display Technology Co., Ltd., Beijing (CN)

(72) Inventors: Guohuo Su, Beijing (CN); Changcheng Liu, Beijing (CN); Zhihua Sun, Beijing (CN); Jiantao Liu, Beijing (CN); Senwang Li, Beijing (CN); Zhun Lin, Beijing (CN); Wenliang Liu, Beijing (CN); Yinlong Zhang, Beijing (CN); Jituo Tang, Beijing (CN); Jinling Zhang, Beijing (CN)

(73) Assignees: Beijing BOE Display Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/670,884

(22) Filed: Feb. 14, 2022

(65) Prior Publication Data

US 2022/0262289 A1 Aug. 18, 2022

(30) Foreign Application Priority Data

Feb. 18, 2021 (CN) ..... 202110190269.0

(51) Int. Cl.
*G09G 3/00* (2006.01)
*G09G 5/06* (2006.01)

(52) U.S. Cl.
CPC ..... *G09G 3/006* (2013.01); *G09G 5/06* (2013.01); *G09G 2320/0276* (2013.01);
(Continued)

(58) Field of Classification Search
CPC .. G09G 3/006; G09G 5/06; G09G 2320/0673; G09G 2320/0276;
(Continued)

(56) References Cited

U.S. PATENT DOCUMENTS

2002/0019983 A1* 2/2002 Emsley ..... H04N 7/10 348/E17.001
2015/0206485 A1* 7/2015 Kim ..... G09G 3/3607 345/89
(Continued)

FOREIGN PATENT DOCUMENTS

CN 101211035 A * 7/2008
CN 101211035 A 7/2008
(Continued)

OTHER PUBLICATIONS

CN202110190269.0 first office action.

*Primary Examiner* — Shaheda A Abdin
(74) *Attorney, Agent, or Firm* — IPRO, PLLC

(57) ABSTRACT

A method for debugging the display panel includes: acquiring a target correction data table of the display panel in each of at least one color mode by debugging the display panel in each of the at least one color mode. Debugging the display panel in each of the at least one color mode includes: controlling the display panel to display a test picture in the color mode; acquiring an initial display parameter curve based on a display parameter of the test picture; determining a reference display parameter curve based on the initial display parameter curve and a standard display parameter curve; and determining the target correction data table based on the reference display parameter curve and the standard display parameter curve.

19 Claims, 7 Drawing Sheets

(52) U.S. Cl.
CPC . *G09G 2360/141* (2013.01); *G09G 2360/145* (2013.01); *G09G 2370/12* (2013.01)

(58) Field of Classification Search
CPC ..... G09G 2320/0242; G09G 3/2007; G09G 2360/141; G09G 2370/12
See application file for complete search history.

(56) References Cited

U.S. PATENT DOCUMENTS

| | | | | |
|---|---|---|---|---|
| 2015/0302788 | A1 | 10/2015 | Kim et al. | |
| 2016/0343340 | A1 | 11/2016 | Zheng et al. | |
| 2017/0045957 | A1* | 2/2017 | Holmgren ..... | G06V 30/1423 |
| 2018/0102088 | A1 | 4/2018 | Deng | |
| 2020/0286423 | A1 | 9/2020 | Yu et al. | |

FOREIGN PATENT DOCUMENTS

| | | | | |
|---|---|---|---|---|
| CN | 103325357 | A | | 9/2013 |
| CN | 103761948 | A | * | 4/2014 |
| CN | 103761948 | A | | 4/2014 |
| CN | 103996391 | A | | 8/2014 |
| CN | 104464637 | A | | 3/2015 |
| CN | 105741762 | A | | 7/2016 |
| CN | 108550345 | A | | 9/2018 |
| CN | 109036326 | A | | 12/2018 |
| CN | 109147707 | A | | 1/2019 |
| CN | 109166555 | A | | 1/2019 |
| JP | 2017003756 | A | * | 1/2017 |

* cited by examiner

METHOD, APPARATUS AND SYSTEM FOR DEBUGGING DISPLAY PANEL

The present application claims priority of the Chinese patent application No. 202110190269.0 filed on Feb. 18, 2021 and entitled "SYSTEM, APPARATUS AND METHOD FOR DEBUGGING DISPLAY PANEL", the disclosure of which is incorporated herein by reference in its entirety.

TECHNICAL FIELD

The present disclosure relates to a method, apparatus and system for debugging a display panel.

BACKGROUND

At present, display panels have been widely applied to mobile phones, computers and other electronic devices for fulfilling functions such as image display and human-computer interaction. In order to have an excellent display effect, it is necessary to debug the display panel by, for example, correcting its gamma parameter, white balance parameter and the like.

SUMMARY

The present disclosure relates to a method, apparatus and system for debugging a display panel.

In a first aspect, a method for debugging a display panel is provided. The method includes:

acquiring a target correction data table of the display panel in each of at least one color mode by debugging the display panel in each of the at least one color mode, wherein debugging the display panel in each of the at least one color mode includes:

controlling the display panel to display a test picture in the color mode;

acquiring an initial display parameter curve of the display panel in the color mode based on a display parameter of the test picture;

determining a reference display parameter curve of the display panel in the color mode based on the initial display parameter curve and a standard display parameter curve of the display panel in the color mode; and determining the target correction data table of the display panel in the color mode based on the reference display parameter curve and the standard display parameter curve.

Optionally, determining the reference display parameter curve of the display panel in the color mode based on the initial display parameter curve and the standard display parameter curve of the display panel in the color mode includes:

determining a reference correction data table based on the initial display parameter curve and the standard display parameter curve; and determining the reference display parameter curve based on the reference correction data table and the initial display parameter curve.

Optionally, determining the target correction data table of the display panel in the color mode based on the reference display parameter curve and the standard display parameter curve includes:

determining the reference correction data table as the target correction data table of the display panel in the color mode, in response to the reference display parameter curve being consistent with the standard display parameter curve; or updating the reference correction data table such that a reference display parameter curve determined based on an updated reference correction data table and the initial display parameter curve is consistent with the standard display parameter curve and determining the updated reference correction data table as the target correction data table of the display panel in the color mode, in response to the reference display parameter curve being inconsistent with the standard display parameter curve.

Optionally, updating the reference correction data table includes: updating the reference correction data table based on a deviation between the reference display parameter curve and the standard display parameter curve.

Optionally, the method further includes:

detecting whether a data processing unit in the display panel turns off a processing function; and acquiring the standard display parameter curve of the display panel in the color mode based on preset standard information, in response to the data processing unit turning off the processing function, or acquiring the standard display parameter curve of the display panel in the color mode based on an initial display parameter deviation and the preset standard information, in response to the data processing unit turning on the processing function, wherein the initial display parameter deviation is a deviation between the initial display parameter curve of the display panel in the color mode when the data processing unit is in a state that the processing function is turned on and the initial display parameter curve of the display panel in the color mode when the data processing unit is in a state that the processing function is turned off.

Optionally, controlling the display panel to display the test picture in the color mode includes:

controlling the display panel to display a plurality of test pictures in the color mode, wherein the plurality of test pictures correspond to a plurality of gray scales of the display panel; and acquiring the initial display parameter curve of the display panel in the color mode based on the display parameter of the test picture includes:

acquiring an initial display parameter corresponding to each of the plurality of gray scales by detecting a display parameter of the test picture corresponding to each of the plurality of gray scales; and generating the initial display parameter curve based on the initial display parameters corresponding to the plurality of gray scales.

Optionally, the display parameter includes a gamma parameter, and the initial display parameter curve includes a gamma curve;

acquiring the initial display parameter corresponding to each of the plurality of gray scales by detecting the display parameter of the test picture corresponding to each of the plurality of gray scales includes:

acquiring display luminance of the test picture corresponding to each of the gray scales by detecting luminance of the test picture corresponding to the gray scale; and determining the gamma parameter corresponding to each of the gray scales based on the gray scale and the display luminance of the test picture corresponding to the gray scale; and generating the initial display parameter curve based on the initial display parameters corresponding to the plurality of gray scales includes: generating the gamma curve based on the gamma parameters corresponding to the plurality of gray scales.

Optionally, the display parameter includes a white balance parameter and the initial display parameter curve includes a white balance curve;

acquiring the initial display parameter corresponding to each of the plurality of gray scales by detecting the display parameter of the test picture corresponding to each of the plurality of gray scales includes:

acquiring color coordinates of a designated point in the test picture corresponding to each of the plurality of gray scales by detecting color coordinates of the test picture corresponding to each of the plurality of gray scales, and determining a white balance parameter corresponding to each of the plurality of gray scales based on the gray scale and the color coordinates of the designated point in the test picture corresponding to each of the plurality of gray scales; and generating the initial display parameter curve based on the initial display parameters corresponding to the plurality of gray scales includes: generating the white balance parameter curve based on the white balance parameters corresponding to the plurality of gray scales.

Optionally, the number of the gray scales is 256, the number of the test pictures is 256, and the test pictures correspond to the gray scales one by one.

Optionally, the at least one color mode includes a gray scale mode, a red mode, a green mode and a blue mode.

Optionally, before debugging the display panel, the method further includes: inputting designated display data for displaying a designated picture to the display panel, wherein the designated picture is configured to detect whether a display function of the display panel works normally; and debugging the display panel in each of the at least one color mode includes: debugging the display panel in each of the at least one color mode, in response to the display function of the display panel working normally.

In a second aspect, an apparatus for debugging a display panel is provided. The apparatus is configured to acquire a target correction data table of the display panel in each of at least one color mode by debugging the display panel in the color mode.

The apparatus for debugging includes:

a driving unit, configured to control the display panel to display a test picture in the color mode, an acquiring unit, configured to acquire an initial display parameter curve of the display panel in the color mode based on a display parameter of the test picture;

a first determining unit, configured to determine a reference display parameter curve of the display panel in the color mode based on the initial display parameter curve and a standard display parameter curve of the display panel in the color mode; and a second determining unit, configured to determine the target correction data table of the display panel in the color mode based on the reference display parameter curve and the standard display parameter curve.

Optionally, the first determining unit includes:

a data table generating subunit, configured to determine a reference correction data table based on the initial display parameter curve and the standard display parameter curve; and a curve generating subunit, configured to determine the reference display parameter curve based on the reference correction data table and the initial display parameter curve.

Optionally, the second determining unit is configured to:

determine the reference correction data table as the target correction data table of the display panel in the color mode, in response to the reference display parameter curve being consistent with the standard display parameter curve; or update the reference correction data table such that the reference display parameter curve determined based on the updated reference correction data table and the initial display parameter curve is consistent with the standard display parameter curve and determine the updated reference correction data table as the target correction data table of the display panel in the color mode, in response to the reference display parameter curve being inconsistent with the standard display parameter curve.

In a third aspect, an apparatus for debugging a display panel is provided. The apparatus includes:

a debugger, configured to acquire a target correction data table of the display panel in each of at least one color mode by debugging the display panel in the color mode, wherein the debugger is configured to:

control the display panel to display a test picture in the color mode;

acquire an initial display parameter curve of the display panel in the color mode based on a display parameter of the test picture;

determine a reference display parameter curve of the display panel in the color mode based on the initial display parameter curve and a standard display parameter curve of the display panel in the color mode; and determine the target correction data table of the display panel in the color mode based on the reference display parameter curve and the standard display parameter curve.

Optionally, the debugger is configured to:

determine a reference correction data table based on the initial display parameter curve and the standard display parameter curve; and determine the reference display parameter curve based on the reference correction data table and the initial display parameter curve.

Optionally, the debugger is further configured to:

determine the reference correction data table as the target correction data table of the display panel in the color mode, in response to the reference display parameter curve being consistent with the standard display parameter curve; or update the reference correction data table such that the reference display parameter curve determined based on the updated reference correction data table and the initial display parameter curve is consistent with the standard display parameter curve and determine the updated reference correction data table as the target correction data table of the display panel in the color mode, in response to the reference display parameter curve being inconsistent with the standard display parameter curve.

Optionally, the debugger is further configured to: update the reference correction data table based on a deviation between the reference display parameter curve and the standard display parameter curve.

Optionally, the apparatus further includes:

a data input port connected to the debugger; and at least two data output ports connected to the debugger, wherein the data output ports are configured to connect the apparatus for debugging the display panel to a peripheral circuit of the display panel; and the types of the at least two data output ports are different.

Optionally, the at least two data output ports include a V-By-One port and a high-definition multimedia interface (HDMI), the V-By-One port is configured to be connected to a timing controller of the display panel, and the HDMI is configured to be connected to a system-on-a-chip (SOC) of the display panel.

Optionally, the apparatus further includes:

a first transient interference suppressor connected to the data input port and the debugger;

a second transient interference suppressor connected to the at least two data output ports and the debugger;

a crystal oscillator connected to the debugger and configured to provide a clock reference frequency to the debugger;

an operational amplifier connected to the debugger and the second transient interference suppressor; and a memory connected to the debugger and configured to cache data of the debugger.

Optionally, the apparatus further includes:

a power supplier connected to the debugger and configured to provide electric energy to the debugger;

a power input port connected to the power supplier and configured to be connected to a power supply source outside the apparatus for debugging the display panel; and a power output port connected to the power supplier and configured to be connected to the display panel.

In a fourth aspect, a system for debugging a display panel is provided. The system includes:

the apparatus for debugging the display panel according to the above second aspect or any optional embodiments thereof, or the apparatus for debugging the display panel according to the above third aspect or any optional embodiments thereof; and a detecting apparatus configured to detect a display parameter of the test picture.

DETAILED DESCRIPTION

Figure 1:
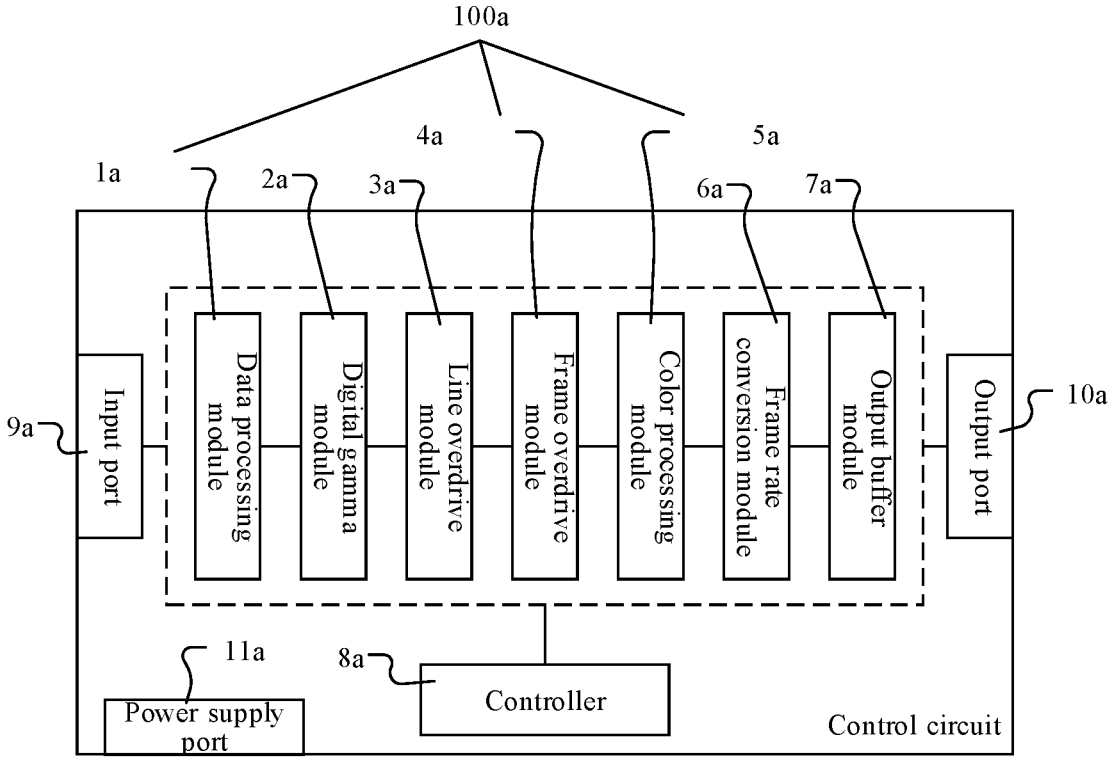
FIG. 1 is a schematic diagram of a control circuit according to an embodiment of the present disclosure.

Embodiments of the present disclosure will be described below with reference to the accompanying drawings. The embodiments can be implemented in various ways and shall not be construed as limited to the embodiments set forth herein. These embodiments are provided to make the present disclosure full and complete, and exemplarily convey the concept of the present disclosure to those skilled in the art. In the drawings, the same reference numerals denote the same or similar structures, and thus the repeated description thereof will be omitted. In addition, the accompanying drawings are only schematic illustrations of the present disclosure, and are not necessarily drawn to scale.

In the present disclosure, the terms such as "a", "an", "the", "said" and "at least one" are used to indicate the presence of one or more elements/components etc. The terms "include" and "have" are used to indicate the meaning including an opening inclusion and indicate that there may be other elements/components etc. in addition to the listed elements/components/etc. The terms such as "first", "second", "third" and "fourth" are only used as reference only, not as a restriction on the number of their subjects. The term "and/or" merely describes association relationships among associated objects, and may indicate three relationships. For example, "A and/or B" may indicate that A exists alone, or A and B exist simultaneously, or B exists alone. In addition, the character "/" herein generally indicates that the context object is an "OR" relationship.

At present, a common display apparatus includes an organic light-emitting display apparatus and a liquid crystal display apparatus. The liquid crystal display apparatus includes a backlight module and a liquid crystal display panel. The liquid crystal display panel includes an array substrate and a color film substrate arranged in a manner of cell alignment, and liquid crystal disposed between the array substrate and the color film substrate. The backlight module is disposed at one side of the array substrate distal from the color film substrate, and is configured to provide backlight required for display. The liquid crystal is configured to adjust a light transmittance of the liquid crystal display panel so as to adjust a gray scale. The liquid crystal display panel usually includes a display region and a peripheral region outside the display region. The display region has a pixel circuit; and a peripheral region has a peripheral circuit connected to the pixel circuit. The peripheral circuit usually includes a source drive circuit, a gate drive circuit, a gamma circuit, a control circuit, etc. The control circuit may be a system-on-a-chip (SOC) or a timing controller, or a combination of the two.

For example, please refer to FIG. 1, which is a schematic diagram of a control circuit according to an embodiment of the present disclosure. The control circuit may be the timing controller. The control circuit includes a data processing module 1*a*, a digital gamma module 2*a*, a line overdrive module 3*a*, a frame overdrive module 4*a*, a color processing module 5*a*, a frame rate conversion module 6*a* and an output buffer module 7*a*. The digital gamma module 2*a* may be connected to a gamma circuit (not shown in FIG. 1) for gamma debugging. The data processing module 1*a*, the frame overdrive module 4*a* and the color processing module 5*a* all belong to a data processing unit 100*a* (that is, the data processing unit 100*a* includes the data processing module 1*a*, the frame overdrive module 4*a* and the color processing module 5*a*). The control circuit further includes a controller 8*a*, an input port 9*a*, an output port 10*a* and a power supply port 11*a*. The controller 8*a* may control the data processing module 1*a*, the digital gamma module 2*a*, the line overdrive module 3*a*, the frame overdrive module 4*a*, the color processing module 5*a*, the frame rate conversion module 6*a* and the output buffer module 7*a*. The input port 9*a* is configured to enable a device outside the control circuit to input data to the control circuit. The output port 10*a* is configured to enable the control circuit to output the data. The power supply port 11*a* is configured to be connected to a power supply device outside the control circuit, such that power is supplied to the control circuit.

Taking the liquid crystal display apparatus as an example, before an image is displayed, the control circuit inputs a gate control signal to the gate drive circuit, and inputs a source control signal to the source drive circuit through the gamma circuit; the gate drive circuit inputs a scanning signal to a pixel circuit under the control of the gate control signal; the source drive circuit inputs the data signal to the pixel circuit under the control of the source control signal. The data signal can control a state of the liquid crystal, and then enable the liquid crystal display panel to display the image in combination with light emitted from the backlight module. The gamma circuit is configured to match the source control signal with a predetermined corresponding relationship between a gray scale and a control voltage, such that the display luminance of the display panel conforms to the human eye's perception of luminance. The corresponding relationship between the gray scale and the control voltage may be acquired through gamma debugging of the display panel. As corresponding relationships between gray scales and control voltages of different display panels are usually different, the display panels need to be debugged respectively. in addition, it is necessary to debug the white balance of the display panel to enable the display panel to have a predetermined display effect.

Taking gamma debugging as an example, before gamma debugging is performed on a display panel, a gamma curve (namely, a corresponding relationship between a gray scale and display luminance of the display panel) of the display panel is established; and then, the gamma curve of the display panel is corrected, and the corresponding relationship between the gray scale and a control voltage of the display panel is determined based on the corrected gamma curve. In a working process of the display panel, the display of the display panel is controlled based on the corresponding relationship between the gray scale and the control voltage. Generally speaking, the gamma curve of the display panel needs to meet a gamma 2.2 curve. For an 8-bit display panel, which includes 256 gray scales, if the gamma curve of the display panel is required to meet the gamma 2.2 curve, the gamma debugging needs to be performed to the display panel at 256 gray scales, causing a larger amount of debugging work and difficulty in operation.

In addition, different manufacturers debug display panels in different ways. Some manufacturers use timing controllers (TCON) for gamma debugging, while others use SOCs for gamma debugging, which leads to lower universality and higher cost of gamma debugging. Moreover, during the gamma debugging, the data processing unit in the control circuit (the TCON or the SOC) is usually required to turn off the processing function to avoid interference with the gamma debugging process. For example, as shown in FIG. 1, in the gamma debugging process, it is necessary to at least turn off the processing functions of the data processing module 1*a*, the frame overdrive module 4*a* and the color processing module 5*a* to prevent them from affecting the accuracy of the gamma debugging.

Figure 2:
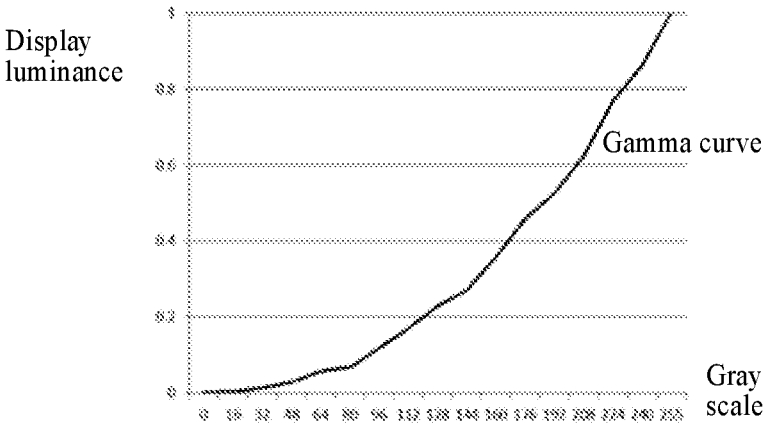
FIG. 2 is a schematic diagram of a gamma curve in the related art.

In the related art, a plurality of tie-point resistors (i.e., resistor strings) connected in series is usually arranged in the peripheral circuit of the display panel to realize resistance voltage division; and gamma debugging at a plurality of gray scales is performed by applying voltages at both ends of the resistor strings and acquiring a plurality of tie-point voltages. For example, if 10 to 18 tie-point resistors connected in series are arranged in the peripheral circuit of the display panel, 10 to 18 tie-point voltages may be acquired accordingly. However, for the 8-bit display panel including 256 gray scales, it is obvious that the 10 to 18 tie-point voltages cannot match with the 256 gray scales, resulting in the lower accuracy of a gamma curve acquired based on the 10 to 18 tie-point voltages, that is, the accuracy of the gamma debugging is lower. For example, FIG. 2 shows a schematic diagram of a gamma curve acquired in the related art. For the gamma curve, the horizontal axis represents gray scales, and the vertical axis represents display luminance (which may be normalized display luminance or display luminance percentages). The smoothness of the gamma curve is lower, which indicates that the accuracy of the gamma curve is lower. In addition, if more tie-point resistors are arranged in the peripheral circuit of the display panel to improve the accuracy of the gamma debugging, it will likely lead to excessive power consumption of the peripheral circuit and a bigger impedance error in the circuit. Especially, for an 8K LCD panel, the power consumption is higher, and the error is bigger.

The embodiments of the present disclosure provide a method, apparatus and system for debugging a display panel. The apparatus for debugging the display panel can acquire a target correction data table of the display panel in each of at least one color mode by debugging the display panel in any one of the at least one color mode. The target correction data table may be used for the display of the display panel, for example for the correction of a control voltage (such as a source control signal) by the gamma circuit, so as to improve a display effect of the display panel. In the embodiments of the present disclosure, the debugging of the display panel can be realized without arranging a tie-point resistor in a peripheral circuit of the display panel, the debugging accuracy is higher, and increase of the power consumption of the peripheral circuit is avoided. The method for debugging the display panel can be applied to a TCON and/or a SOC, which is higher in universality and lower in cost.

The embodiments of the method for debugging the display panel of the present disclosure will be introduced below with reference to the accompanying drawings.

A method for debugging a display panel is provided according to an embodiment of the present disclosure. The method for debugging the display panel is executable by an apparatus for debugging the display panel. The method may include: acquiring a target correction data table of the display panel in each of at least one color mode by debugging the display panel in any one of the at least one color mode.

Here, the target correction data table is used for the display of the display panel. For example, the target correction data table is used for correction of a control voltage (such as a source control signal) by the gamma circuit, such that a picture meeting a predetermined requirement can be displayed on the display panel.

Here, when debugging the display panel, the apparatus for debugging the display panel can control the display panel to be in each of at least one color mode sequentially through the peripheral circuit of the display panel. In each color mode, the display panel may display a picture which may be monochrome. For example, the at least one color mode includes a gray scale mode, a red mode, a green mode and a blue mode. The display panel displays a gray picture in the gray scale mode, a red picture in the red mode, a green picture in the green mode and a blue picture in the blue mode. The color modes of the display panel, including the gray scale mode, red mode, green mode and blue mode, are only exemplary. The color modes of the display panel may be more or less, and are not limited in the present embodiment of the present disclosure.

When the display panel is in any one of the color modes, the apparatus for debugging the display panel can acquire the target correction data table of the display panel in the color mode by debugging the display panel in the color mode. Processes of debugging the display panel by the apparatus in different color modes are the same. The following takes an example in which the apparatus debugs the display panel in one color mode (for convenience of description, this color mode is called a first color mode). The processes of debugging the display panel by the apparatus for debugging the display panel in other color modes may refer to the following description.

Figure 3:
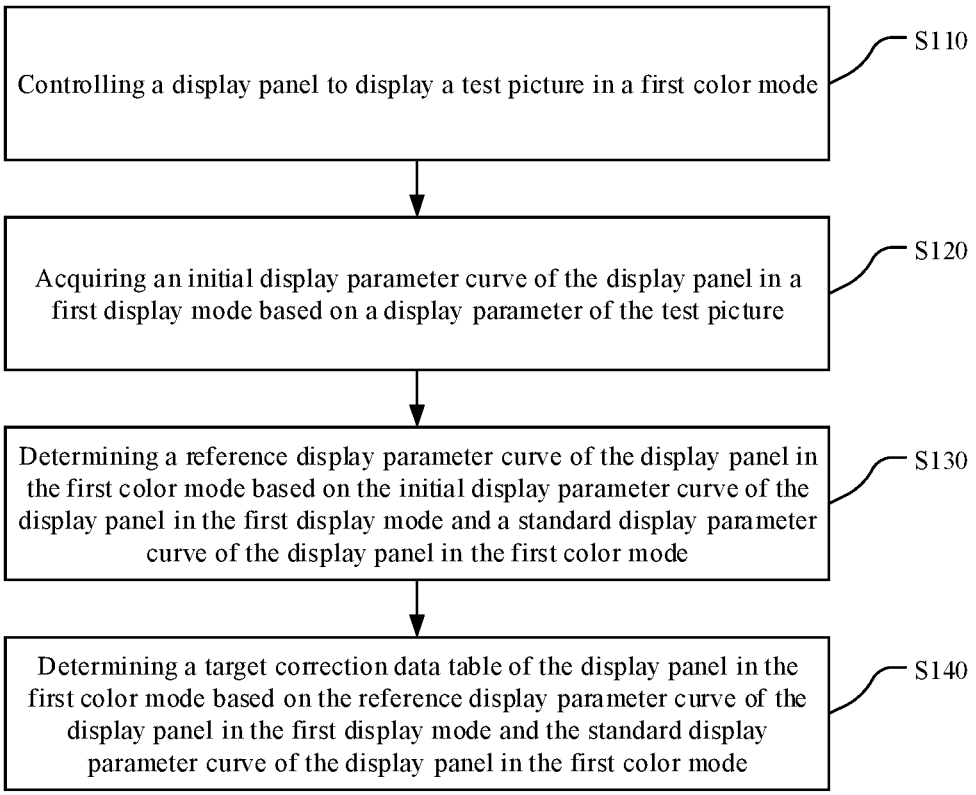
FIG. 3 is a flow chart of a method for debugging a display panel according to an embodiment of the present disclosure.

For example, please refer to FIG. 3, which is a flow chart of a method for debugging a display panel according to an embodiment of the present disclosure. The method may include the following S110 to S140.

In S110, the display panel is controlled to display a test picture in a first color mode.

In S120, an initial display parameter curve of the display panel in a first display mode is acquired based on a display parameter of the test picture.

Here, the display parameter may include at least one of a gamma parameter and a white balance parameter. Accordingly, the initial display parameter curve may include at least one of a gamma curve or a white balance curve. The display parameter may further include other display parameters, and the initial display parameter curve may further include other display parameter curves, which are not limited in the present embodiment of the present disclosure.

Here, the gamma parameter may include a gray scale and display luminance. For example, the gamma parameter is a two-dimensional parameter composed of the gray scale and the display luminance and the gamma curve may be a relationship curve between the gray scale and the display luminance. The white balance parameter may include the gray scale and color coordinates. For example, the white balance parameter is a two-dimensional parameter composed of the gray scale and the color coordinates, and the white balance curve may be a relationship curve between the gray scale and the color coordinates.

In S130, a reference display parameter curve of the display panel in the first color mode is determined based on the initial display parameter curve of the display panel in the first display mode and a standard display parameter curve of the display panel in the first color mode.

Here, the standard display parameter curve may include at least one of the gamma curve and the white balance curve, and for example, includes a gamma 2.2 curve. The reference display parameter curve may be a display parameter curve acquired after correcting the initial display parameter curve, and may include at least one of the gamma curve and the white balance curve.

In S140, a target correction data table of the display panel in the first color mode is determined based on the reference display parameter curve of the display panel in the first display mode and the standard display parameter curve of the display panel in the first color mode.

In summary, according to the method for debugging the display panel, the apparatus for debugging the display panel can debug the display panel in each of the at least one color mode. In addition, when debugging the display panel in each color mode, the apparatus for debugging the display panel determines the reference display parameter curve based on the initial display parameter curve and the standard display parameter curve, and determines the target correction data table of the display panel in the color mode based on the reference display parameter curve and the standard display parameter curve. In the embodiment of the present disclosure, the debugging of the display panel can be realized without arranging a tie-point resistor in a peripheral circuit of the display panel, the debugging accuracy is higher, and increase of the power consumption of the peripheral circuit is avoided. Moreover, the method for debugging the display panel can be applied to a TCON and/or a SOC, which is higher in universality and lower in cost.

The implementations of above S110 to S140 will be introduced below respectively. For the sake of distinction, in the following introduction, the gamma curve as the initial display parameter curve is called the initial gamma, curve, the white balance curve as the initial display parameter curve is called the initial white balance curve, the gamma curve as the standard display parameter curve is called the standard gamma curve, the white balance curve as the standard display parameter curve is called the standard white balance curve, the gamma curve as the reference display parameter curve is called the reference gamma curve, and the white balance curve as the reference display parameter curve is called the reference white balance curve.

Firstly, the implementation of S110 is introduced.

In S110, the apparatus for debugging the display panel can control the display panel to display the test picture in the first color mode through the peripheral circuit of the display panel, and the test picture may be a monochrome picture. For example, when the first color mode is the gray scale mode, the test picture is gray; when the first color mode is the red mode, the test picture is red; when the first color mode is the green mode, the test picture is green; and when the first color mode is the blue mode, the test picture is blue.

In an optional embodiment, the apparatus for debugging the display panel controls the display panel to display a plurality of test pictures in the first color mode, and the plurality of test pictures correspond to a plurality of gray scales. For example, the number of the test pictures is equal to the number of the gray scales, and the test pictures correspond to the gray scales one by one. That is, the apparatus for debugging the display panel controls the display panel to display a test picture at each gray scale in the first color mode. In some embodiments, the apparatus for debugging the display panel can control the display panel to display the plurality of test pictures sequentially. For example, the display panel sequentially displays the test pictures in an ascending gray scale order.

All the test pictures may be monochrome pictures, the colors of the test pictures may be the same, and the display luminance of the test pictures may be different. For example, if the number of the gray scales is 256, the number of the test pictures is 256, and the first color mode is the red mode, the test pictures are 256 red pictures with different pieces of display luminance.

In the present embodiment is illustrated by taking that the number of the test pictures in the first color mode is 256 as an example. This description is only exemplary. The present embodiment does not limit the number of the test pictures in the first color mode, and the number of the test pictures in the first color mode may be 200, 150, or the like. Since the number of the gray scales of the display panel is generally 256, the number of the test pictures in the first color mode is set to 256 such that the 256 test pictures in the first color mode and the 256 gray scales of the display panel may be in a one-to-one correspondence, which is helpful to improve the debugging accuracy.

The above introduces the implementation of S110, and the following is the introduction of the implementation of S120.

In S120, the apparatus for debugging the display panel can acquire the display parameter of the test picture by detecting the test picture displayed by the display panel, and acquire the initial display parameter curve of the display panel in the first color mode based on the display parameter of the test picture.

Figure 4:
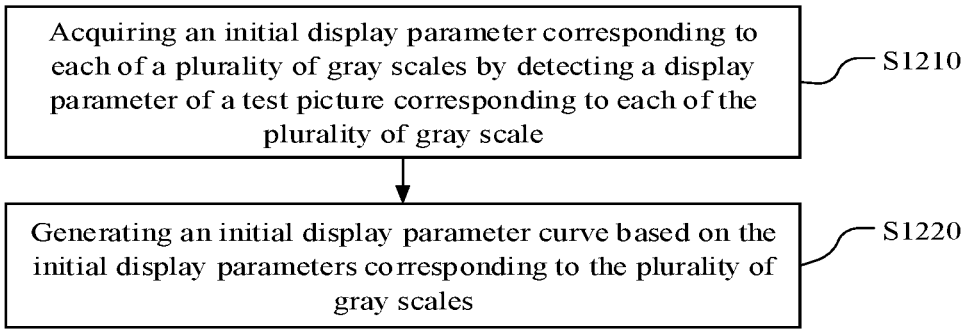
FIG. 4 is a flow chart of a method for acquiring an initial display parameter curve according to an embodiment of the present disclosure.

For example, please refer to FIG. 4, which is a flow chart of a method for acquiring an initial display parameter curve of a display panel in a first color mode by an apparatus for debugging the display panel according to an embodiment of the present disclosure. As shown in FIG. 4, the method includes the following S1210 to S1220.

In S1210, an initial display parameter corresponding to each of the gray scales is acquired by detecting a display parameter of the test picture corresponding to each of the gray scales.

The apparatus for debugging the display panel can acquire the initial display parameter corresponding to each of the gray scales by detecting the display parameter of the test picture corresponding to the gray scale through a detecting apparatus. For example, the apparatus for debugging the display panel acquires the initial display parameter corresponding to each of the gray scales by shooting and detecting the test picture corresponding to each of the gray scales through the detecting apparatus. The detecting apparatus may be an optical detector, and may be integrated in the apparatus for debugging the display panel or disposed outside the apparatus for debugging the display panel and connected to the apparatus for debugging the display panel, which is not limited in the present embodiment of the present disclosure.

In the embodiment of the present disclosure, the display parameter (such as the initial display parameter) may include at least one of the gamma parameter and the white balance parameter. The gamma parameter may include a gray scale and display luminance, and the white balance parameter may include the gray scale and color coordinates. For example, the gamma parameter is a two-dimensional parameter composed of the gray scale and the display luminance, and the white balance parameter is a two-dimensional parameter composed of the gray scale and the color coordinates. In some embodiments, the display parameter (such as the initial display parameter) includes the gamma parameter, and S1210 includes: acquiring display luminance of a test picture corresponding to each of the gray scales by detecting the luminance of the test picture corresponding to each of the gray scales through the apparatus for debugging the display panel, and determining the gamma parameter corresponding to each of the gray scales by the apparatus for debugging the display panel based on each of the gray scales and the display luminance of the test picture corresponding to each of the gray scales. In other embodiments, the display parameter (such as the initial display parameter) includes the white balance parameter, and S1210 includes: acquiring color coordinates of a designated point in a test picture corresponding to each of the gray scales by detecting the color coordinates of the test picture corresponding to each of the gray scales through the apparatus for debugging the display panel, and determining the white balance parameter corresponding to each of the gray scales by the apparatus for debugging the display panel based on each of the gray scales and the color coordinates of the designated point in the test picture corresponding to each of the gray scales.

In S1220, the initial display parameter curve is generated based on the initial display parameters corresponding to the gray scales.

The initial display parameter corresponding to each of the gray scales is a two-dimensional parameter, and the gray scales may correspond to two-dimensional initial display parameters, and the apparatus for debugging the display panel can draw the initial display parameter curve based on the initial display parameters corresponding to the gray scales. In some embodiments, the initial display parameter includes the gamma parameter, and the apparatus for debugging the display panel generates a gamma curve (namely, an initial gamma curve) based on the gamma parameters corresponding to the gray scales. In other embodiments, the initial display parameter includes the white balance parameter, and the apparatus for debugging the display panel generates a white balance curve (namely, an initial white balance curve) based on the white balance parameters corresponding to the gray scales.

The above introduces the implementation of S120, and the following is the introduction of the implementation of S130.

In S130, a reference display parameter curve of the display panel in the first color mode can be generated by the apparatus for debugging the display panel based on the initial display parameter curve of the display panel in the first display mode and a standard display parameter curve of the display panel in the first color mode.

Figure 5:
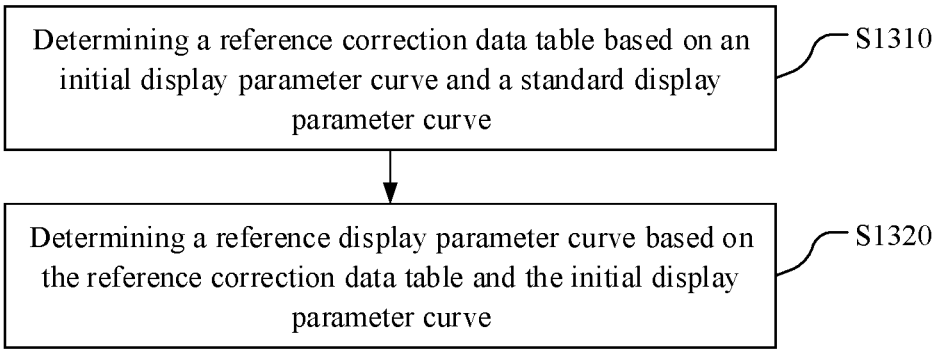
FIG. 5 is a flow chart of a method for acquiring a reference display parameter curve according to an embodiment of the present disclosure.

For example, please refer to FIG. 5, which shows a flow chart of a method for acquiring a reference display parameter curve based on an initial display parameter curve and a standard display parameter curve by an apparatus for debugging a display panel according to an embodiment of the present disclosure. As shown in FIG. 5, the method includes the following S1310 to S1320.

In S1310, a reference correction data table is determined based on the initial display parameter curve and the standard display parameter curve.

The apparatus for debugging the display panel can determine a deviation between the initial display parameter curve and the standard display parameter curve by comparing the initial display parameter curve with the standard display parameter curve, so as to determine the reference correction data table. Here, the reference correction data table may be a look up table (LUT) and is configured to provide basis for debugging the display parameter curve, and data in the reference correction data table may include a deviation value between the initial display parameter curve and the standard display parameter curve.

In the present embodiment, the initial display parameter curve may include at least one of the initial gamma curve and the initial white balance curve. Accordingly, the standard display parameter curve may include at least one of the standard gamma curve and the standard white balance curve, and the reference correction data table may include at least one of a gamma correction data table and a white balance correction data table. For the sake of distinction, the gamma correction data table as the reference correction data table is called the reference gamma correction table, and the white balance correction data table as the reference correction data table is called the reference white balance correction table.

In an embodiment of S1310, the initial display parameter curve is the initial gamma curve, and the standard display parameter curve is the standard gamma curve, and the apparatus for debugging the display panel determines the reference gamma correction table based on the initial gamma curve and the standard gamma curve. Here, the data in the reference gamma correction table may include a plurality of gray scales and a luminance difference corresponding to each gray scale, and the luminance difference corresponding to each gray scale is a difference value between the display luminance corresponding to each gray scale in the standard gamma curve and the display luminance corresponding to each gray scale in the initial gamma curve. Or, the data in the reference gamma correction table includes a plurality of display luminance and a gray scale difference corresponding to each piece of display luminance, and the gray scale difference corresponding to each piece of display luminance is a difference value between the gray scale corresponding to each piece of display luminance in the standard gamma curve and the gray scale corresponding to each piece of display luminance in the initial gamma curve.

In another embodiment of S1310, the initial display parameter curve is the initial white balance curve, and the standard display parameter curve is the standard white balance curve, and the apparatus for debugging the display panel determines the reference white balance correction table based on the initial white balance curve and the standard white balance curve. Here, the data in the reference white balance correction table may include a plurality of gray scales and a color coordinate difference corresponding to each gray scale, and the color coordinate difference corresponding to each gray scale is a difference value between the color coordinate corresponding to each gray scale in the standard white balance curve and the color coordinate corresponding to each gray scale in the initial white balance curve. Or, the data in the reference white balance correction table includes a plurality of color coordinates and a gray scale difference corresponding to each color coordinate, and the gray scale difference corresponding to each color coordinate is a difference value between the gray scale corresponding to each color coordinate in the standard white balance curve and the gray scale corresponding to each color coordinate in the initial white balance curve.

The embodiment of the present disclosure takes an example in which the apparatus for debugging the display panel determines the reference correction data table based on the deviation between the initial display parameter curve and the standard display parameter curve for illustration. In other embodiments, the reference correction data table may be acquired based on empirical data or by other methods, as long as it can be used to adjust the display parameter curve. The method for acquiring the reference correction data table is not limited in the embodiment of the present disclosure.

In S1320, the reference display parameter curve is determined based on the reference correction data table and the initial display parameter curve.

The reference display parameter curve can be generated by the apparatus for debugging the display panel based on the reference correction data table and the initial display parameter curve. For example, the apparatus for debugging the display panel acquires the reference display parameter curve by correcting (or adjusting) the initial display parameter curve based on the reference correction data table. Compared with the deviation between the reference display parameter curve and the standard display parameter curve, the deviation between the initial display parameter curve and the standard display parameter curve is smaller. In other words, the reference display parameter curve, which is closer to the standard display parameter curve, can be generated based on the reference correction data table. Due to an error in data processing, the reference display parameter curve and the standard display parameter curve may be inconsistent, and of course, it may also be consistent, which is not limited in the embodiment of the present disclosure.

In the embodiment of the present disclosure, the initial display parameter curve may include at least one of the initial gamma curve and the initial white balance curve. The reference correction data table may include at least one of the reference gamma correction table and the reference white balance correction table. Accordingly, the reference display parameter curve may include at least one of the reference gamma curve and the reference white balance curve. In an embodiment, the initial display parameter curve includes the initial gamma curve, the reference correction data table includes the reference gamma correction table, and the apparatus for debugging the display panel determines the reference gamma curve based on the reference gamma correction table and the initial gamma curve. In another embodiment, the initial display parameter curve includes the initial white balance curve, the reference correction data table includes the reference white balance correction table, and the apparatus for debugging the display panel determines the reference white balance curve based on the reference white balance correction table and the initial white balance curve.

The above introduces the implementation of S130, and the following is the introduction of the implementation of S140.

In S140, a target correction data table of the display panel in the first color mode can be determined by the apparatus for debugging the display panel based on the reference display parameter curve and the standard display parameter curve.

Optionally, the apparatus for debugging the display panel determines whether the reference display parameter curve is consistent with the standard display parameter curve by comparing the reference display parameter curve with the standard display parameter curve. If the reference display parameter curve is consistent with the standard display parameter curve, the apparatus for debugging the display panel determines the reference correction data table acquired in S1310 as the target correction data table of the display panel in the first color mode. If the reference display parameter curve is inconsistent with the standard display parameter curve, the apparatus for debugging the display panel updates the reference correction data table acquired in S1310 such that the reference display parameter curve, which is determined based on the updated reference correction data table and the initial display parameter curve, is consistent with the standard display parameter curve, and determines the updated reference correction data table as a target correction data table of the display panel in the first color mode. For example, the apparatus for debugging the display panel updates the reference correction data table based on a deviation between the reference display parameter curve and the standard display parameter curve.

For example, if the reference display parameter curve is inconsistent with the standard display parameter curve, the apparatus for debugging the display panel updates the reference correction data table based on the deviation between the reference display parameter curve and the standard display parameter curve, updates the reference display parameter curve based on the updated reference correction data table, and compares the updated reference display parameter curve with the standard display parameter curve, and the above process is cyclically executed until the reference display parameter curve, which is determined by the apparatus for debugging the display panel based on the updated reference correction data table and the initial display parameter curve, is consistent with the standard display parameter curve; and the apparatus for debugging the display panel determines the reference correction data table as the target correction data table of the display panel in the first color mode, when the reference display parameter curve is consistent with the standard display parameter curve. The apparatus for debugging the display panel can improve the debugging accuracy of the display panel by continuously updating the reference correction data table to acquire the target correction data table, thereby maximizing the debugging accuracy of the display panel.

The implementation of S140 described above may be applied to both gamma correction and white balance correction. For example, when the reference display parameter curve is the reference gamma curve and the standard display parameter curve is the standard gamma curve, in S140, the apparatus for debugging the display panel determines the target gamma correction table (namely, the target correction data table) based on the reference gamma curve and the standard gamma curve. For instance, if the reference display parameter curve is the reference white balance curve and the standard display parameter curve is the standard white balance curve, in S140, the apparatus for debugging the display panel determines the target white balance correction table (namely, the target correction data table) based on the reference white balance curve and the standard white balance curve.

In the embodiment of the present disclosure, the gray scales in the reference display parameter curve and the gray scales in the standard display parameter curve correspond to each other one by one and are the same. Taking an example in which the reference display parameter curve and the standard display parameter curve are both gamma curves, the reference display parameter curve (i.e., the reference gamma curve) being consistent with the standard display parameter curve (i.e., the standard gamma curve) means that, for each of the gray scales in the standard display parameter curve, the display luminance corresponding to the gray scale in the reference display parameter curve is the same as that corresponding to the gray scale in the standard display parameter curve (that is, the reference display parameter curve and the standard display parameter curve coincide). Or, for each of n gray scales in the standard display parameter curve, the display luminance corresponding to the gray scale in the reference display parameter curve is the same as that corresponding to the gray scale in the standard display parameter curve, and n is greater than 80% and 90% of the total number of the gray scales in the standard display parameter curve. When the reference display parameter curve and the standard display parameter curve are both white balance curves, the reference display parameter curve is consistent with the standard display parameter curve in the same sense, and the display luminance described above can be replaced by the color coordinates, which will not described in detail herein.

After acquiring the target correction data table of the display panel in the first color mode, the apparatus for debugging the display panel can provide the target correction data table to a peripheral circuit of the display panel. In a working process of the display panel, the peripheral circuit corrects a control voltage based on the target correction data table to allow the display panel to display. For example, the target correction data table is a target gamma correction table, the data in the target gamma correction table includes a plurality of display luminance and a gray scale difference corresponding to each piece of the display luminance, and the apparatus for debugging the display panel can provide the target gamma correction table to the gamma circuit. In the working process of the display panel, the gamma circuit can perform gray scale correction based on display luminance required to be achieved and a gray scale difference corresponding to the display luminance in the target gamma correction table, and inputs a source control signal to a source drive circuit of the display panel based on a control voltage (each gray scale corresponding to one control voltage) corresponding to the corrected gray scale to drive the display panel to display.

Figure 6:
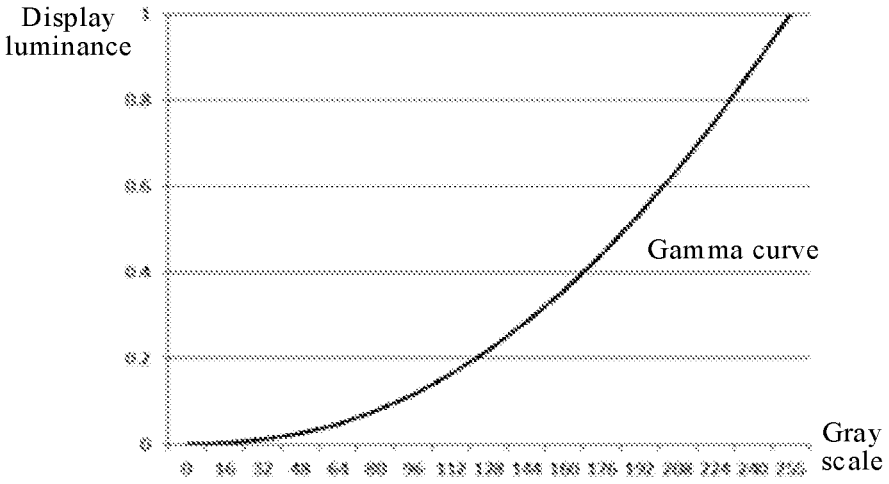
FIG. 6 is a schematic diagram of a gamma curve according to an embodiment of the present disclosure.

The above S130 to S140 may be a process of correcting the initial display parameter curve. Taking the initial display parameter curve is the gamma curve as an example, the gamma curve shown in FIG. 6 can be acquired through the above S130 to S140. It can be seen that the gamma curve shown in FIG. 6 is obviously smoother and more accurate compared with the gamma curve shown in FIG. 2, which indicates that the method for debugging the display panel according to the embodiment of the present disclosure can improve the accuracy of gamma debugging, In the embodiment of the present disclosure, the apparatus for debugging the display panel can cyclically update the reference correction parameter based on a comparison result between the reference display parameter curve and the standard display parameter curve until the target correction data table is acquired, such that the debugging accuracy can be maximized. In the working process of the display panel, the gray scale correction can be performed based on the target correction data table, such that the display effect of the display panel can be improved.

Figure 7:
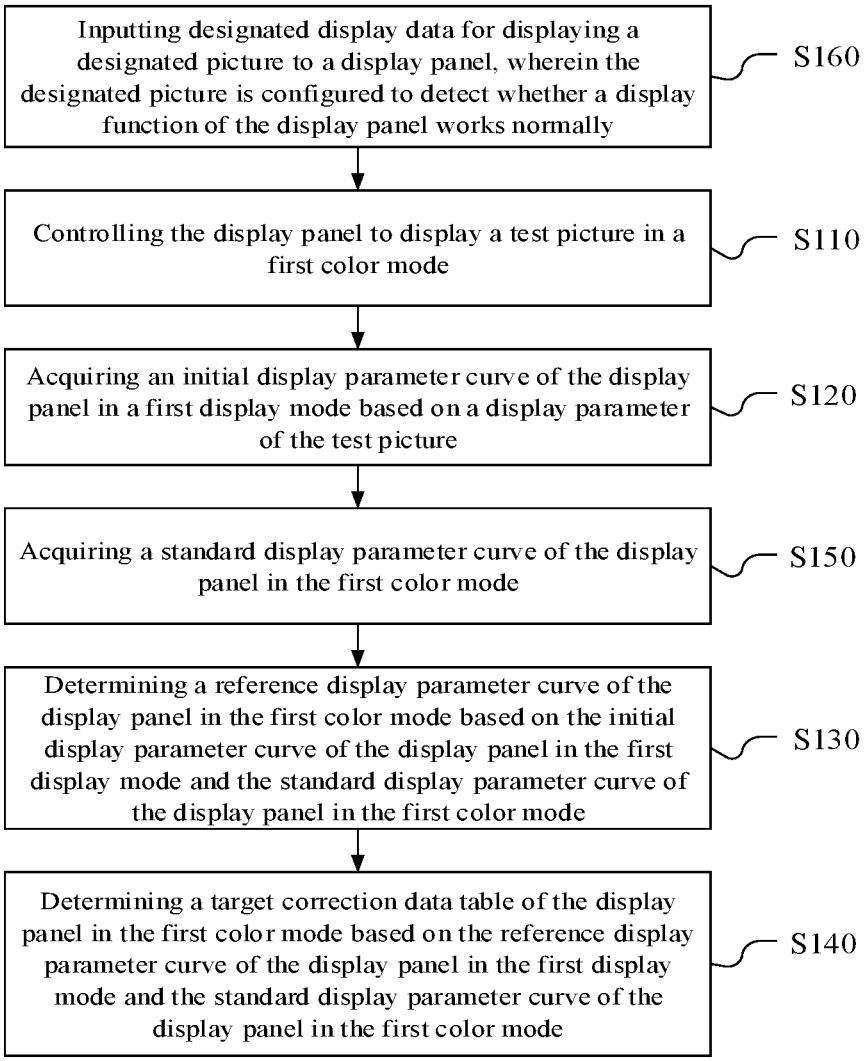
FIG. 7 is a flow chart of another method for debugging a display panel according to the embodiment of the present disclosure.

In an optional embodiment, please refer to FIG. 7, which shows a flow chart of another method for debugging a display panel according to an embodiment of the present disclosure. The method for debugging the display panel further includes the following S150.

In S150, a standard display parameter curve of the display panel in the first color mode is acquired.

S150 may be before S130. For example, S150 is between S120 and S130.

Here, the standard display parameter curve may be stored in advance and called when the display panel is debugged, or may be set in real time according to debugging requirements, and its determination method is not limited herein.

Figure 8:
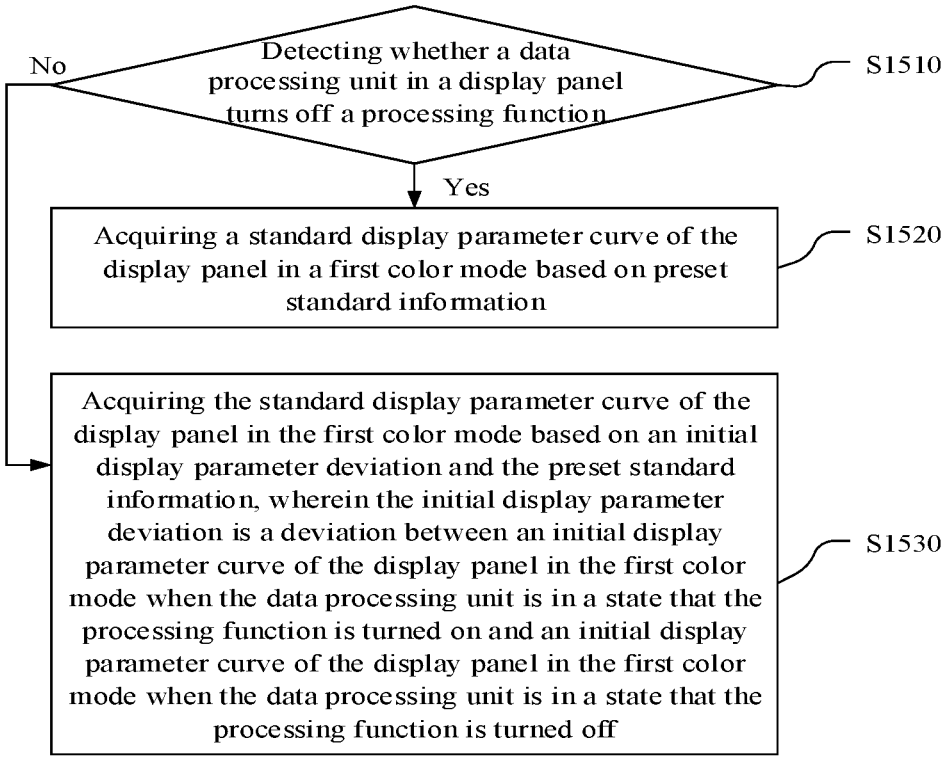
FIG. 8 is a flow chart of a method for acquiring a standard display parameter curve according to an embodiment of the present disclosure.

For example, please refer to FIG. 8, which is a flow chart of a method for acquiring a standard display parameter curve of a display panel in a first color mode by an apparatus for debugging the display panel according to an embodiment of the present disclosure. The method may include the following S1510 to S1530.

In S1510, whether the data processing unit in the display panel turns off the processing function is detected. If the data processing unit turns off the processing function, S1520 is executed. If the data processing unit turns on the processing function, S1530 is executed.

For example, the apparatus for debugging the display panel detects whether the data processing unit is powered off. If the data processing unit is powered off, the apparatus for debugging the display panel determines that the data processing unit turns off the processing function. If the data processing unit is not powered off, the apparatus for debugging the display panel determines that the data processing unit turns on the processing function. As shown in FIG. 1, the data processing unit includes the data processing module 1*a*, the frame overdrive module 4*a* and the color processing module 5*a*. The data processing unit may further include other processing units, which are not limited herein. In addition, the apparatus for debugging the display panel may also detect whether the data processing unit turns off the processing function in other ways. The embodiment of the present disclosure does not limit the way through which the apparatus for debugging the display panel detects whether the data processing unit turns off the processing function.

In S1520, the standard display parameter curve of the display panel in the first color mode is acquired based on preset standard information.

Here, the preset standard information is preset information for determining the standard display parameter curve. For example, if the standard display parameter curve is the gamma 2.2 curve, the preset standard information may be information for determining or generating the gamma 2.2 curve. For example, in a case that the first color mode is the red mode, the standard display parameter curve is the gamma 2.2 curve in the red mode.

Optionally, the apparatus for debugging the display panel stores the standard display parameter curve of the display panel in the first color mode, and acquires the standard display parameter curve from a storage module of the apparatus based on the preset standard information. Or, the apparatus for debugging the display panel generates the standard display parameter curve based on the preset standard information.

In S1530, the standard display parameter curve of the display panel in the first color mode is acquired based on an initial display parameter deviation and the preset standard information, where the initial display parameter deviation is a deviation between the initial display parameter curve of the display panel in the first color mode when the data processing unit is in a state that the processing function is turned on and the initial display parameter curve of the display panel in the first color mode when the data processing unit is in a state that the processing function is turned off.

Optionally, the apparatus for debugging the display panel acquires an initial display parameter curve (for example, the initial display parameter curve 1) of the display panel in the first color mode when the data processing unit is in the state that the processing function is turned on and an initial display parameter curve (for example, the initial display parameter curve 2) of the display panel in the first color mode when the data processing unit is in the state that the processing function is turned off, acquires the initial display parameter deviation by determining the deviation between the initial display parameter curve 1 and the initial display parameter curve 2, and generates the standard display parameter curve of the display panel in the first color mode based on the initial display parameter deviation and the preset standard information. For example, the apparatus for debugging the display panel generates a preset standard curve based on the preset standard information, and acquires the standard display parameter curve of the display panel in the first color mode by correcting the preset standard curve based on the initial display parameter deviation. Since the preset standard curve is corrected based on the initial display parameter deviation, the influence on the debugging accuracy caused by turn-on of the processing function by the data unit is counteracted, which is convenient to avoid interference in the debugging accuracy by the data processing unit. Thus, the debugging accuracy is improved.

In an optional embodiment, before debugging the display panel, the apparatus for debugging the display panel can detect whether the display function of the display panel works normally. After ensuring that the display function of the display panel works normally, the apparatus for debugging the display panel performs the above debugging steps. As shown in FIG. 7, the method for debugging the display panel according to the present disclosure further includes the following S160.

In S160, designated display data for displaying a designated picture is input to the display panel, and the designated picture is configured to detect whether the display function of the display panel works normally.

The apparatus for debugging the display panel can input the designated display data to the display panel through the peripheral circuit of the display panel, and the display panel can display the designated picture based on the designated display data. The designated picture is any picture that can be displayed normally, and the content of the designated picture is not limited herein.

Here, the picture displayed by the display panel based on the designated display data may or may not be the designated picture, and the apparatus for debugging the display panel can judge whether the display function of the display panel works normally according to whether the picture actually displayed by the display panel is the designated picture. For example, a high-resolution display panel (for example, an 8K display panel) allows for partitioned displays, and the apparatus for debugging the display panel can judge whether the picture actually displayed by the display panel is the designated picture by comparing pictures displayed in partitions with the designated picture. If the picture actually displayed by the display panel is the designated picture, it is determined that the display function of the display panel works normally. If the picture actually displayed by the display panel is not the designated picture, it is determined that the display function of the display panel works abnormally.

If the display function of the display panel works normally, the apparatus for debugging the display panel can perform S110 to S150 to debug the display panel. If the display function of the display panel works abnormally, the apparatus for debugging the display panel does not perform the debugging steps, but prompts a worker to repair or replace the display panel. By executing S160, the apparatus for debugging the display panel can screen out the display panel with the abnormal display function, so as ensure the reliability of a debugging result.

Although steps of the method for debugging the display panel according to the present disclosure are described in the accompany drawings according to a particular order, it does not require or imply that these steps must be executed in accordance with the specific order or a desired result cannot be realized until all shown steps are executed. Additionally or alternatively, some steps may be omitted, multiple steps may be integrated into one step to be performed, and/or a step may be divided into multiple steps. Change methods which can be easily expected by any person skilled in the art within the technical scope disclosed by the present disclosure should be covered by the protection scope of the present disclosed.

The above is the introduction of the embodiments of the method for debugging the display panel according to the present disclosure, and the following is the introduction of the embodiments of an apparatus for debugging the display panel according to the present disclosure. The apparatus for debugging the display panel can execute the embodiments of the above method for debugging the display panel.

An apparatus for debugging a display panel is provided according to the present disclosure. The apparatus is configured to acquire a target correction data table of the display panel in each of at least one color mode by debugging the display panel in each of at least one color mode.

Figure 9:
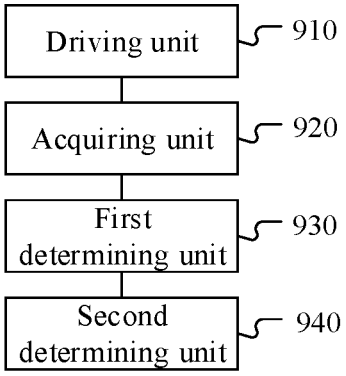
FIG. 9 is a schematic structure diagram of an apparatus for debugging a display panel according to an embodiment of the present disclosure.

For example, please refer to FIG. 9, which is a schematic structure diagram of an apparatus for debugging a display panel according to an embodiment of the present disclosure. The apparatus for debugging the display panel includes a driving unit 910, an acquiring unit 920, a first determining unit 930 and a second determining unit 940.

The driving unit 910 is configured to control the display panel to display a test picture in a color mode.

The acquiring unit 920 is configured to acquire an initial display parameter curve of the display panel in the color mode based on a display parameter of the test picture.

The first determining unit 930 is configured to determine a reference display parameter curve of the display panel in the color mode based on the initial display parameter curve and a standard display parameter curve of the display panel in the color mode.

The second determining unit 940 is configured to determine the target correction data table of the display panel in the color mode based on the reference display parameter curve and the standard display parameter curve.

Optionally, the first determining unit 930 includes:

a data table generating subunit, configured to determine a reference correction data table based on the initial display parameter curve and the standard display parameter curve; and a curve generating subunit, configured to determine the reference display parameter curve based on the reference correction data table and the initial display parameter curve.

Optionally, the second determining unit 940 is configured to:

determine the reference correction data table as the target correction data table of the display panel in the color mode if the reference display parameter curve is consistent with the standard display parameter curve; or update the reference correction data table if the reference display parameter curve is inconsistent with the standard display parameter curve such that the reference display parameter curve determined based on the updated reference correction data table and the initial display parameter curve is consistent with the standard display parameter curve, and determine the updated reference correction data table as the target correction data table of the display panel in the color mode.

Working principles and details of each unit in the apparatus for debugging the display panel according to the present disclosure have been elaborated in the above method for debugging the display panel, and will not be described in detail herein.

Figure 10:
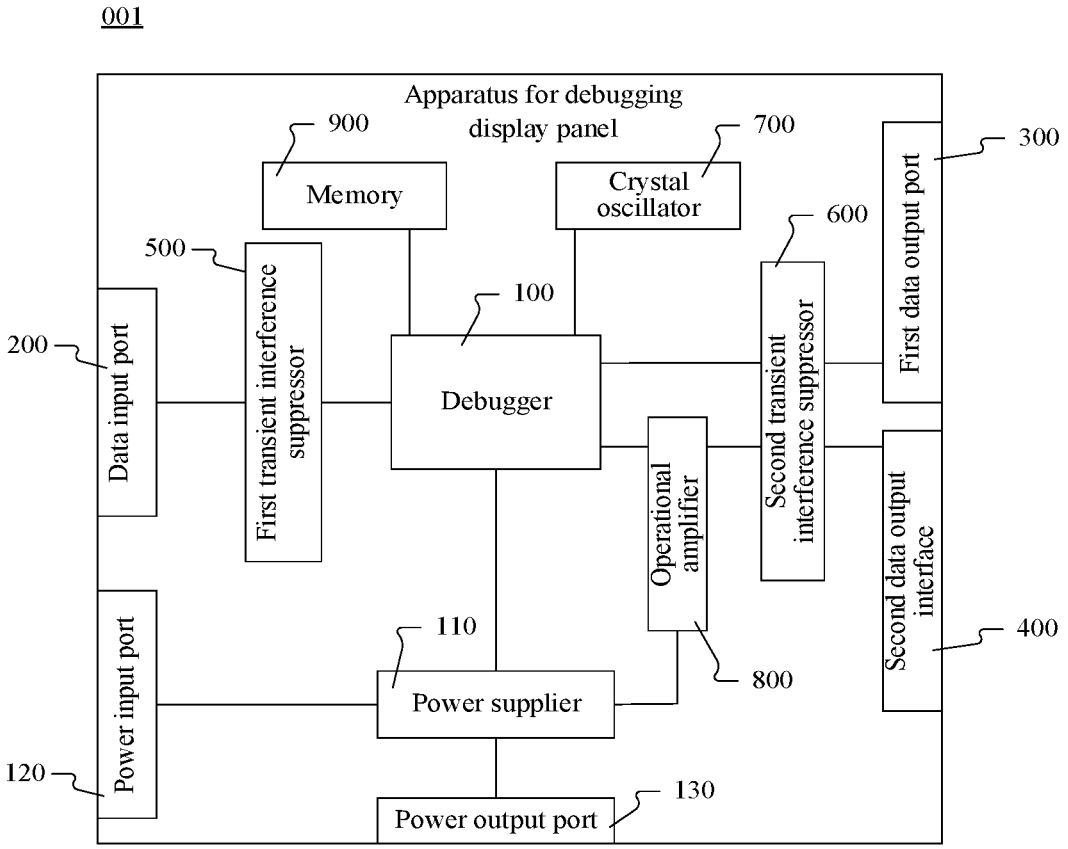
FIG. 10 is a schematic structure diagram of another apparatus for debugging a display panel according to an embodiment of the present disclosure.

For example, please refer to FIG. 10, which is a schematic structure diagram of another apparatus for debugging a display panel according to an embodiment of the present disclosure. The apparatus 001 for debugging the display panel includes a debugger 100 configured to acquire a target correction data table of the display panel in each of at least one color mode by debugging the display panel in each of at least one color mode. A process for debugging the display panel by the debugger 100 may refer to the description of that in the above method for debugging the display panel, and will not be repeated herein. The debugger 100 may be a field programmable gate array (FPGA), but is not limited thereto. It may also be other integrated circuits capable of performing debugging steps.

Optionally, the apparatus 001 for debugging the display panel further includes a data input port 200 and at least two different types of data output ports. In FIG. 10, that at least two data output ports include a first data output port 300 and a second data output interface 400 is taken as an example for description.

The data input port 200 is connected to the debugger 100 and configured to receive an external control signal.

The at least two data output ports are connected to the debugger 100 respectively, and are configured to connect the apparatus 001 to a peripheral circuit of the display panel to output a data signal to the peripheral circuit of the display panel. For example, the first data output port 300 is configured to connect the apparatus 001 to a control circuit of the first display panel. The second data output port 400 is configured to connect the apparatus 001 to a control circuit of the second display panel. The first display panel and the second display panel may be two different display panels. Here, one of the first data output port 300 and the second data output port 400 may be connected to a TCON, and the other thereof may be connected to a SOC. In other words, the control circuit of the first display panel may be the TCON, and may be connected to the first data output port 300, such that the apparatus 001 for debugging the display panel can debug the first display panel. The control circuit of the second display panel may be the SOC, and may be connected to the second data output port 400, such that the apparatus 001 for debugging the display panel can debug the second display panel.

Optionally, the at least two data output ports include a V-By-One port and an HDMI. The V-By-One port is configured to be connected to the TCON, and the HDMI is configured to be connected to the SOC of the display panel. For example, the first data output port 300 is the V-By-One port for being connected to the timing controller. The second data output port 400 is the HDMI configured to be connected to the SOC. Of course, the first data output port 300 and the second data output port 400 may also adopt other types of output ports.

Optionally, the apparatus 001 for debugging the display panel further includes a first transient interference suppressor 500, a second transient interference suppressor 600, a crystal oscillator 700, an operational amplifier 800 and a memory 900.

The first transient interference suppressor 500 is connected to the data input port 200 and the debugger 100. Fax example, the first transient interference suppressor 500 is connected between the data input port 200 and the debugger 100.

The second transient interference suppressor 600 is connected to the at least two data output ports and the debugger 100. For example, the second transient interference suppressor 600 is connected between the first data output port 300 and the debugger 100, and between the second data output port 400 and the debugger 100.

A transient interference signal can be shielded by the first transient interference suppressor 500 and the second transient interference suppressor 600, such that an electro-static discharge (ESD) capability is improved.

The crystal oscillator 700 is connected to the debugger 100, so as to provide a clock reference frequency to the debugger 100.

The operational amplifier 800 is connected to the debugger 100 and the second transient interference suppressor 600 respectively, For example, the operational amplifier 800 is connected between the debugger 100 and the second transient interference suppressor 600. The structure of the operational amplifier 800 is not limited herein, and the operational amplifier 800 can enhance a driving capability of a signal output from the second data output port 400.

The memory 900 is connected to the debugger 100. The memory 900 may be a random access memory (RAM) or other types of memory devices, memory units, memory circuits, etc. The memory 900 is configured to cache the data of the debugger 100.

Optionally, the apparatus 001 for debugging the display panel may further include a power supplier 110, a power input port 120 and a power output port 130.

The power supplier 110 is connected to the debugger 100 and configured to supply power to the debugger 100. The power supplier 110 may include a DC power supplier or an AC power supplier.

The power input port 120 is connected to the power supplier 110, and is configured to be connected to a power supply source outside the apparatus 001 for debugging the display panel, such that power is supplied to the power supplier 110.

The power output port 130 is connected to the power supplier 110, and is configured to be connected to the display panel, such that electric energy is supplied to the display panel, and the display panel is controlled by the apparatus 001 for debugging the display panel.

The apparatus 001 for debugging the display panel according to any of the above embodiments can debug the display parameter of the display panel, and the method for debugging the display panel can be executed without the control circuit (the TCON or SOC) of the display panel. Even if the processing function of the data processing unit of the control circuit of the display panel is not turned off, debugging can be performed. Thus, the universality is higher.

Figure 11:
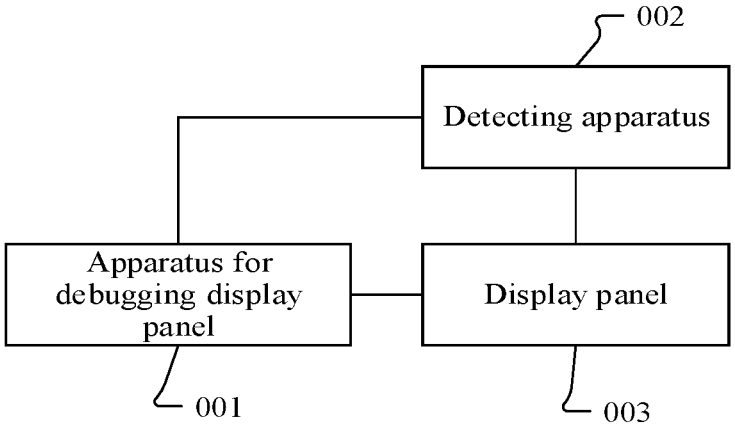
FIG. 11 is a schematic structure diagram of a system for debugging a display panel according to an embodiment of the present disclosure.

A system for debugging a display panel is further provided according to an embodiment of the present disclosure. As shown in FIG. 11, the system for debugging the display panel includes an apparatus 001 for debugging the display panel, a detecting apparatus 002 and a display panel 003.

The apparatus 001 for debugging the display panel may be the apparatus 001 for debugging the display panel according to any of the above embodiments. For example, if the display panel 003 is a first display panel, the apparatus 001 for debugging the display panel may be connected to a TCON of the display panel 003 through a first data output port 300. If the display panel 003 is a second display panel, the apparatus 001 for debugging the display panel may be connected to a SOC of the display panel 003 through a second data output port 400.

The detecting apparatus 002 may be configured to detect a display parameter of a test picture. For example, the detecting apparatus 002 shoots the test picture displayed on the display panel and detects the shot test picture. The display parameter of the test picture detected by the detecting apparatus 002 may be acquired by the apparatus 001 for debugging the display panel.

Other embodiments of the present disclosure will be apparent to those skilled in the art from consideration of the description and practice of the present disclosure disclosed herein. The present disclosure is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the appended claims.

What is claimed is:

1. A method for debugging a display panel, comprising:

acquiring a target correction data table of the display panel in each of at least one color mode by debugging the display panel in each of the at least one color mode, and wherein debugging the display panel in each of the at least one color mode comprises:

controlling the display panel to display a test picture in the color mode;

acquiring an initial display parameter curve of the display panel in the color mode based on a display parameter of the test picture;

detecting whether a data processing unit in the display panel turns off a processing function;

acquiring a standard display parameter curve of the display panel in the color mode based on preset standard information, in response to the data processing unit turning off the processing function, or acquiring the standard display parameter curve of the display panel in the color mode based on an initial display parameter deviation and preset standard information, in response to the data processing unit turning on the processing function, wherein the initial display parameter deviation is a deviation between the initial display parameter curve of the display panel in the color mode when the data processing unit is in a state that the processing function is turned on and the initial display parameter curve of the display panel in the color mode when the data processing unit is in a state that the processing function is turned off;

determining a reference display parameter curve of the display panel in the color mode based on the initial display parameter curve and the standard display parameter curve of the display panel in the color mode; and determining the target correction data table of the display panel in the color mode based on the reference display parameter curve and the standard display parameter curve.

2. The method for debugging the display panel according to claim 1, wherein determining the reference display parameter curve of the display panel in the color mode based on the initial display parameter curve and the standard display parameter curve of the display panel in the color mode comprises:

determining a reference correction data table based on the initial display parameter curve and the standard display parameter curve; and determining the reference display parameter curve based on the reference correction data table and the initial display parameter curve.

3. The method for debugging the display panel according to claim 2, wherein determining the target correction data table of the display panel in the color mode based on the reference display parameter curve and the standard display parameter curve comprises:

determining the reference correction data table as the target correction data table of the display panel in the color mode, in response to the reference display parameter curve being consistent with the standard display parameter curve; or updating the reference correction data table such that a reference display parameter curve determined based on an updated reference correction data table and the initial display parameter curve is consistent with the standard display parameter curve and determining the updated reference correction data table as the target correction data table of the display panel in the color mode, in response to the reference display parameter curve being inconsistent with the standard display parameter curve.

4. The method for debugging the display panel according to claim 3, wherein updating the reference correction data table comprises:

updating the reference correction data table based on a deviation between the reference display parameter curve and the standard display parameter curve.

5. The method for debugging the display panel according to claim 1, wherein controlling the display panel to display the test picture in the color mode comprises: controlling the display panel to display a plurality of test pictures in the color mode, wherein the plurality of test pictures correspond to a plurality of gray scales of the display panel; and acquiring the initial display parameter curve of the display panel in the color mode based on the display parameter of the test picture comprises:

acquiring an initial display parameter corresponding to each of the plurality of gray scales by detecting a display parameter of the test picture corresponding to each of the plurality of gray scales; and generating the initial display parameter curve based on the initial display parameters corresponding to the plurality of gray scales.

6. The method for debugging the display panel according to claim 5, wherein the display parameter comprises a gamma parameter and the initial display parameter curve comprises a gamma curve;

acquiring the initial display parameter corresponding to each of the plurality of gray scales by detecting the display parameter of the test picture corresponding to each of the plurality of gray scales comprises:

acquiring display luminance of the test picture corresponding to each of the gray scales by detecting luminance of the test picture corresponding to the gray scale; and determining the gamma parameter corresponding to each of the gray scales based on the gray scale and the display luminance of the test picture corresponding to the gray scale; and generating the initial display parameter curve based on the initial display parameters corresponding to the plurality of gray scales comprises:

generating the gamma curve based on the gamma parameters corresponding to the plurality of gray scales.

7. The method for debugging the display panel according to claim 5, wherein the display parameter comprises a white balance parameter and the initial display parameter curve comprises a white balance curve;

acquiring the initial display parameter corresponding to each of the plurality of gray scales by detecting the display parameter of the test picture corresponding to each of the plurality of gray scales comprises:

acquiring color coordinates of a designated point in the test picture corresponding to each of the plurality of gray scales by detecting color coordinates of the test picture corresponding to each of the plurality of gray scales; and determining a white balance parameter corresponding to each of the plurality of gray scales based on the gray scale and the color coordinates of the designated point in the test picture corresponding to each of the plurality of gray scales; and generating the initial display parameter curve based on the initial display parameters corresponding to the plurality of gray scales comprises:

generating the white balance parameter curve based on the white balance parameters corresponding to the plurality of gray scales.

8. The method for debugging the display panel according to claim 5, wherein the number of the gray scales is 256, the number of the test pictures is 256, and the test pictures correspond to the gray scales one by one.

9. The method for debugging the display panel according to claim 1, wherein the at least one color mode comprises a gray scale mode, a red mode, a green mode and a blue mode.

10. The method for debugging the display panel according to claim 1, wherein before debugging the display panel, the method further comprises: inputting designated display data for displaying a designated picture to the display panel, wherein the designated picture is configured to detect whether a display function of the display panel works normally; and debugging the display panel in each of the at least one color mode comprises: debugging the display panel in each of the at least one color mode, in response to the display function of the display panel working normally.

11. An apparatus for debugging a display panel, comprising:

a debugger, configured to acquire a target correction data table of the display panel in each of at least one color mode by debugging the display panel in each of the at least one color mode, and wherein the debugger is configured to:

control the display panel to display a test picture in the color mode;

acquire an initial display parameter curve of the display panel in the color mode based on a display parameter of the test picture;

detect whether a data processing unit in the display panel turns off a processing function;

acquire a standard display parameter curve of the display panel in the color mode based on preset standard information, in response to the data processing unit turning off the processing function, or acquire the standard display parameter curve of the display panel in the color mode based on an initial display parameter deviation and preset standard information, in response to the data processing unit turning on the processing function, wherein the initial display parameter deviation is a deviation between the initial display parameter curve of the display panel in the color mode when the data processing unit is in a state that the processing function is turned on and the initial display parameter curve of the display panel in the color mode when the data processing unit is in a state that the processing function is turned off;

determine a reference display parameter curve of the display panel in the color mode based on the initial display parameter curve and the standard display parameter curve of the display panel in the color mode; and determine the target correction data table of the display panel in the color mode based on the reference display parameter curve and the standard display parameter curve.

12. The apparatus for debugging the display panel according to claim 11, wherein the debugger is further configured to:

determine a reference correction data table based on the initial display parameter curve and the standard display parameter curve; and determine the reference display parameter curve based on the reference correction data table and the initial display parameter curve.

13. The apparatus for debugging the display panel according to claim 12, wherein the debugger is further configured to:

determine the reference correction data table as the target correction data table of the display panel in the color mode, in response to the reference display parameter curve being consistent with the standard display parameter curve; or update the reference correction data table such that the reference display parameter curve determined based on the updated reference correction data table and the initial display parameter curve is consistent with the standard display parameter curve and determine the updated reference correction data table as the target correction data table of the display panel in the color mode, in response to the reference display parameter curve being inconsistent with the standard display parameter curve.

14. The apparatus for debugging the display panel according to claim 13, wherein the debugger is further configured to:

update the reference correction data table based on a deviation between the reference display parameter curve and the standard display parameter curve.

15. The apparatus for debugging the display panel according to claim 11, further comprising:

a data input port connected to the debugger; and at least two data output ports connected to the debugger, wherein the data output ports are configured to connect the apparatus for debugging the display panel to a peripheral circuit of the display panel; and wherein types of the at least two data output ports are different.

16. The apparatus for debugging the display panel according to claim 15, wherein the at least two data output ports comprise a V-By-One port and a high-definition multimedia interface HDMI, the V-By-One port is configured to be connected to a timing controller of the display panel, and the HDMI is configured to be connected to a system-on-a-chip (SOC) of the display panel.

17. The apparatus for debugging the display panel according to claim 15, further comprising:

a first transient interference suppressor connected to the data input port and the debugger;

a second transient interference suppressor connected to the at least two data output ports and the debugger;

a crystal oscillator connected to the debugger and configured to provide a clock reference frequency to the debugger;

an operational amplifier connected to the debugger and the second transient interference suppressor; and a memory connected to the debugger and configured to cache data of the debugger.

18. The apparatus for debugging the display panel according to claim 11, further comprising:

a power supplier connected to the debugger and configured to provide electric energy to the debugger;

a power input port connected to the power supplier and configured to be connected to a power supply source outside the apparatus for debugging the display panel; and a power output port connected to the power supplier and configured to be connected to the display panel.

19. A system for debugging a display panel, the system comprising:

the apparatus for debugging the display panel according to claim 11; and a detecting apparatus configured to detect a display parameter of the test picture.

* * * * *